United States Patent [19]

Idec et al.

[11] Patent Number: 4,966,479

[45] Date of Patent: Oct. 30, 1990

[54] COSMETIC CONTAINER CONSTRUCTION

[75] Inventors: Eric J. Idec, Madison; Edward F. Klimeck, Waterbury, both of Conn.

[73] Assignee: Risdon Corporation, Naugatuck, Conn.

[21] Appl. No.: 293,208

[22] Filed: Jan. 4, 1989

[51] Int. Cl.[5] ..... A45D 40/04

[52] U.S. Cl. ..... 401/68; 401/65; 132/320

[58] Field of Search ..... 401/65, 68, 55, 195, 401/DIG. 1; 132/320; 206/385

[56] References Cited

U.S. PATENT DOCUMENTS

| | | | |
|---|---|---|---|
| 3,082,869 | 3/1963 | Bau | 401/DIG. 1 |
| 3,124,244 | 3/1964 | Hopgood | 401/68 |
| 3,335,854 | 8/1967 | Landen | 401/55 |
| 3,338,397 | 8/1967 | Noyack | 132/320 |
| 3,358,699 | 12/1967 | Bau | 401/195 |
| 4,696,594 | 9/1987 | Powers | 401/65 |

*Primary Examiner*—Robert A. Hafer
*Assistant Examiner*—Kerry Owens
*Attorney, Agent, or Firm*—Hopgood, Calimafde, Kalil, Blaustein & Judlowe

[57] ABSTRACT

The invention contemplates a swivel cosmetic container of propel/repel variety wherein metering action is achieved by plural resilient detent engagements which are readily sensed as multiple equal subdivisions of each single revolution of the parts exposed for manipulated relative rotation. And a single elastomeric seal ring establishes hermetic sealing of container contents as well as detent retention of an applied closure cap.

9 Claims, 2 Drawing Sheets

COSMETIC CONTAINER CONSTRUCTION

BACKGROUND OF THE INVENTION

The invention relates to cosmetic containers of the propel/repel variety wherein relative rotation or swivel action between externally exposed base-member and shell-member components is operative via internal mechanism to impart axial propel/repel displacement to a carrier of cosmetic substance within the upper end of the shell member, a closure cap being removably engageable over the upper end of the shell member and into retained relation with the base member.

It is particularly important for certain cosmetic substances having moisturizing/emulsion formulation (1) that the container shall establish a hermetic seal of cosmetic substance when not in use, (2) that propel/repel displacements be kept to a minimum, and (3) that the user shall be able to clearly sense a relatively small effectively metered incremental advance of cosmetic substance, when needed. The continuously smooth camming or threaded advance of conventional container constructions provides no criterion to be sensed for such metering purposes, and therefore the tendency is to propel more substance than needed for each use, and to advance randomly varying increments for each use.

BRIEF STATEMENT OF THE INVENTION

It is the specific object of this invention to provide an improved container construction of the character indicated wherein metering action may be clearly and accurately sensed, upon each dispensing use of the container.

Another specific object, in a container meeting the above object, is to additionally provide for hermetic sealing of container contents and metering functions when the container is closed and not in use.

A general object is to meet the above objects with basically simple structure, lending itself to automated assembly and to injection-molded plastic fabrication.

The invention meets these objects in a swivel container of propel/repel variety wherein metering action is achieved by plural resilient detent engagements which are readily sensed as multiple equal subdivisions of each single revolution of the parts exposed for manipulated relative rotation. And a single elastomeric seal ring establishes hermetic sealing of container contents as well as detent retention of an applied closure cap.

DETAILED DESCRIPTION

The invention will be described in detail for a preferred embodiment, in conjunction with the accompanying drawings, in which.

Figure 1:
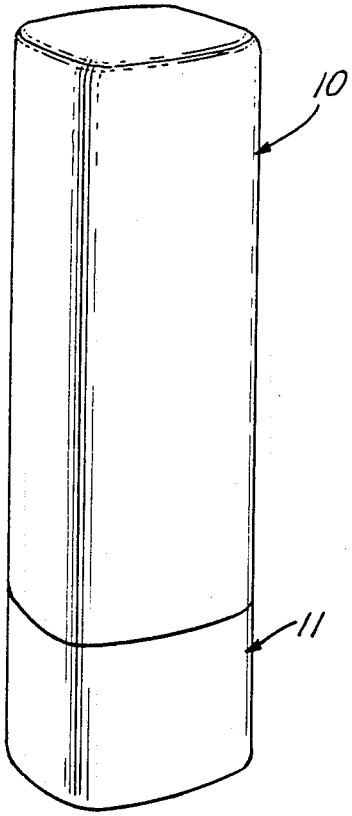
FIG. 1 is a perspective view of a container of the invention, in closed condition.

The container of the invention, in its simplest form, comprises three coacting propulsion components and a closure cap 10. In the closed condition of FIG. 1, the cap 10 and only one of the propulsion components, namely, the base-operating component 11, is visible. The closed container has the appearance of an elongate prism of polygonal section, shown as a somewhat square section, in that the four sides of the "square" are equal but gently bowed, and the "corners" of the square are rounded. Although the purposes of the invention can be served by a square section having straight sides and sharp corners, use of the word "square" herein will be understood to apply equally to a straight-sided and/or to a bow-sided polygonal section, be it a square, a triangle, a pentagon, or a hexagon, i.e., whatever the number of sides of the polygon.

The other two of the three coacting propulsion components are the body-shell component 12, which is uncovered (FIGS. 2 and 3) upon removal of cap 10, and the carrier component 13. The carrier component 13 is seen in FIG. 3 to comprise a cup portion 14 and an integrally formed tubular tail 16 having external threads; cup 14 has an upper lip 15 which is preferably slightly tapered, inwardly in the down direction, and the upper end of the taper has light resilient peripherally continuous wiping and sealing contact with the inner wall of body shell 12. The base-operating member 11 may be of one-piece construction but is shown to comprise a bottom cup 17, press-fitted or otherwise permanently secured to the lower cylindrical end of a generally tubular part 18 having various other surface configurations. One of these configurations is a locally inward thread-tracking lug 19 whereby rotation of carrier 13 (and its threaded tail 16) with respect to the base-operating member 11 will result in axial advance or retraction of carrier 13 and its cosmetic substance 15.

Figure 2:
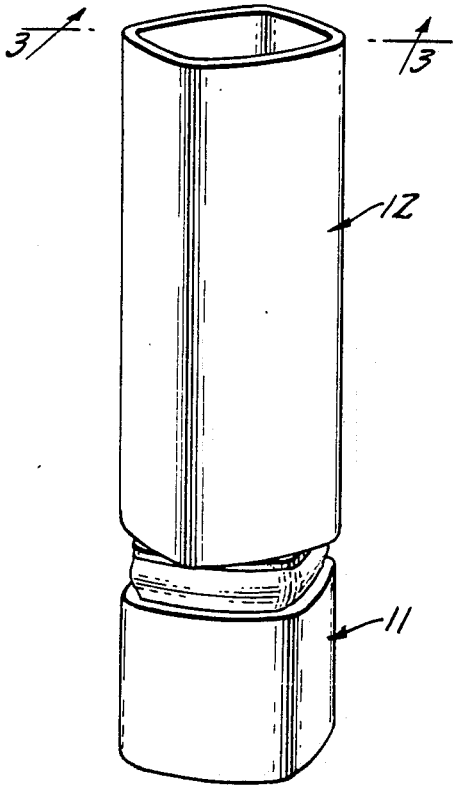
FIG. 2 is a similar view of the container of FIG. 1, in open and partially actuated condition.
Figure 3:
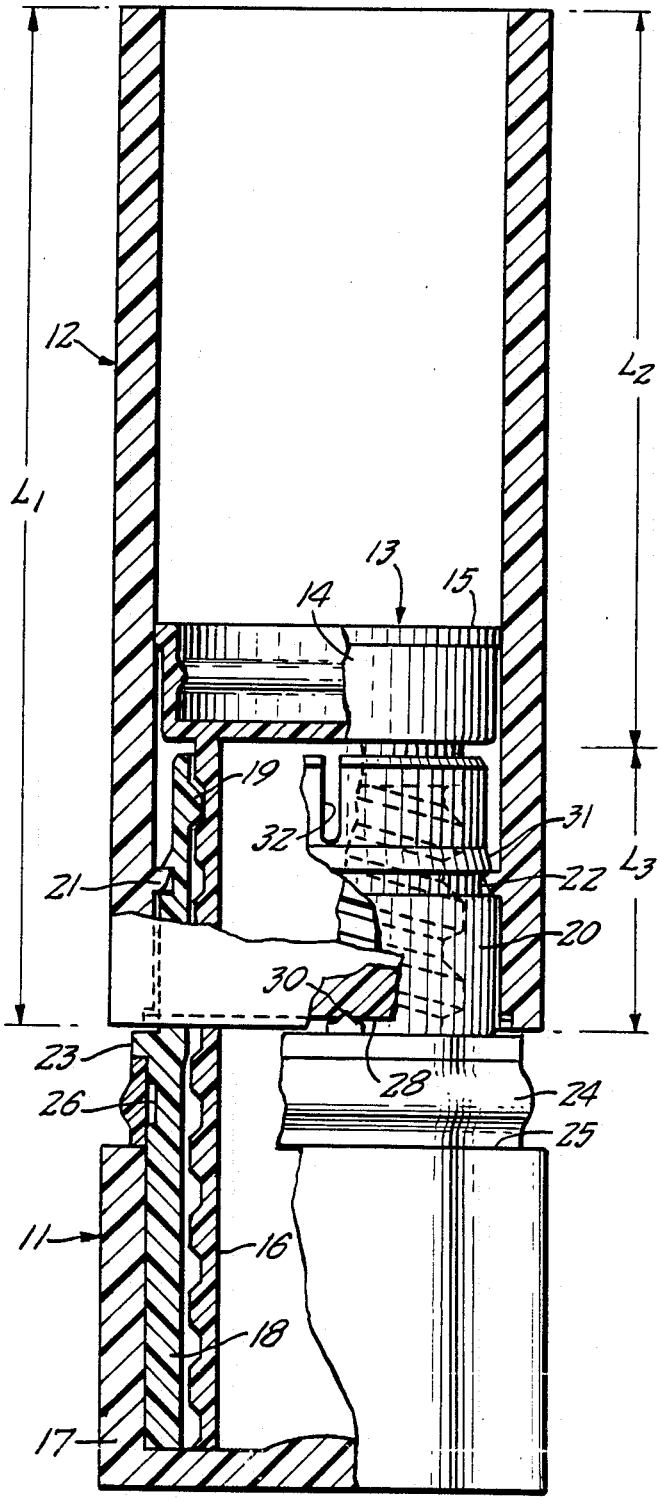
FIG. 3 is a view in elevation on an enlarged scale, partly broken-away and in section, generally in the plane 3—3 of FIG. 2.
Figure 4:
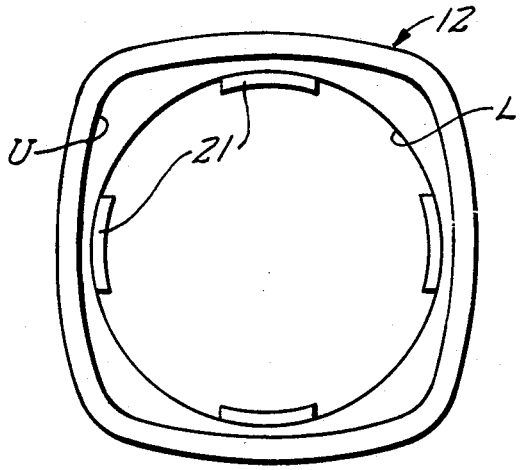
FIG. 4 is a first end view, looking down, of a body-shell component of FIG. 3.
Figure 5:
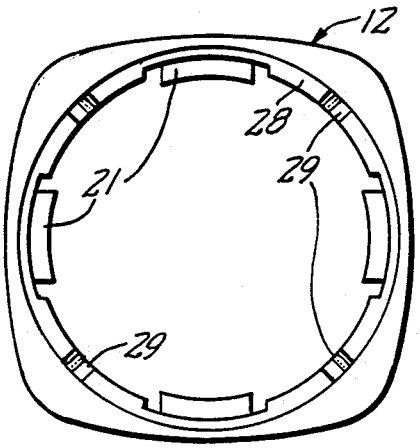
FIG. 5 is a second end view, looking up, for the body shell component of FIGS. 3 and 4.
Figure 6:
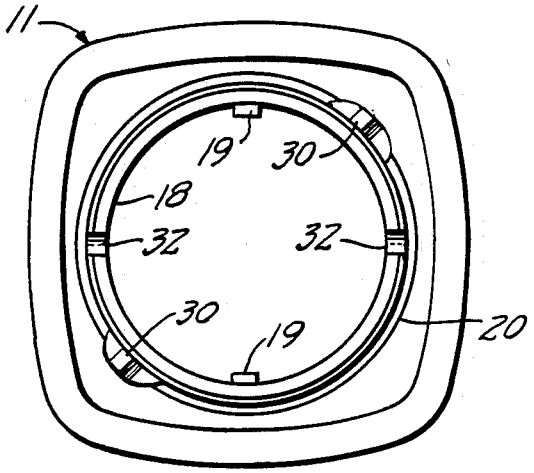
FIG. 6 is an end view, looking down, of a base-operating component of FIG. 3.

In FIG. 2, the full length L1 of body shell 12 is seen to conform generally to the square-section appearance of the base-operating member 11, but with sides of reduced width, for telescoping non-rotational reception of the closure cap 10, when not in use. However, as seen in FIGS. 3 to 6, the bore of body shell 12 is characterized by a greater upper length L2 of square-section conformance to the external surface of the body shell, and by a lesser lower length L3 of circular continuity. The skirt portion of carrier cup 14 conforms with axially-running but non-rotational fit to the square-section profile of the upper length L2 of the body-shell bore; and within the lower length L3, the body-shell bore is cylindrical and has a rotational running fit to an upper cylindrical-land portion 20 of the base-operating member 11. To assure that this rotational fit shall be axially retained, a plurality of angularly spaced lugs 21 project integrally and inwardly from the cylindrical-bore portion of the body shell, and these lugs 21 locate in a circumferential-groove feature 22 of the upper end portion of the base-operating member 11. Manual rotation of the base-operating member 11 with respect to the body-shell member thus drives carrier 13 in accordance with the direction of relative rotation; and if, as is preferred, the threads of tail 16 are of double-lead variety, lug 19 will be understood to be one of two such lugs at diametrically opposed locations, each being engaged to a different one of the helical paths of the double-lead thread formation, thus assuring development of balanced propel/repel thrust action on the carrier, whatever the direction of relative rotation of components 11–12.

Figure 7:
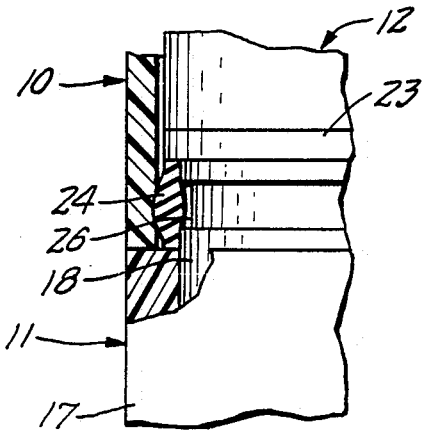
FIG. 7 is an enlarged fragmentary detail to show a seal engagement when the container is closed.

Axially beneath its lower end, body shell 12 is seen in FIG. 3 to have running clearance with a flange formation 23 of the base-operating member 11, and the external profile of flange 23 will be understood to be square, in conformance with the external contour of body shell 12 when components 11-12 are rotated into angular registration of their respective square profiles. An elastomeric seal ring 24 of similarly square external profile is captive on the base-operating member 11, in the axial space between flange 23 and the shoulder 25 afforded by the upper end of cup 17. The external profile of seal ring 24 has an axially central bulge between reduced axial ends, and this bulge is in axial register with a shallow peripheral groove formation 26 in the base-operating part 18. As seen in FIG. 7, the bulge of seal ring 24 has transient interference-fit compliant inward deformability within groove 26, upon closure-cap (10) placement over flange 23 and the seal ring, and a resiliently retained sealing engagement develops for the seal-ring bulge within a shallow undercut groove 27 in the bore of the closure cap, when the cap is driven into abutment with shoulder; this relationship can only be achieved upon registration of the square profiles of flange 23 and of body shell 12, and in view of the square profile of the skirt of the closure cap, an anti-rotational lock is applied by cap 10 to the propulsion mechanism, in addition to the described seal engagement.

It is a feature of the invention that the user of the container shall be able to sense metered fractions of the axial extent of possible carrier propulsion. In the form shown, this is achieved by detent action which modifies required propulsion torque, at equal fractions of each full revolution of components 11–12 with respect to each other. For illustrative purposes, the present container provides four such equally dividing detent actions for each such full relative revolution, and axial symmetry of detent-reaction force is afforded by providing each detent action in duplicate, at diametrically opposed locations.

More specifically, the lower end of body shell 12 is counterbored to provide at 28 an annular surface of circular continuity, and this surface is interrupted with a small axial recess (see FIG. 7), at each of four equally spaced locales. To provide detent action, two diametrically opposite local axially upward projections 30 are integral formations of the upper annular face of flange 23 of the base-operating part 18. And the relation of parts is preferably such that, when parts 18 and 12 are axially assembled to each other (as facilitated by a frustoconical cam surface 30 of part 18), an axially preloading force exists when projections 29 ride the annular surface 27, but this preloading force noticeably reduces to zero or near-zero, upon rotation into the relation of FIGS. 2 and 3, wherein projections 29 are received in the recesses 28 of one of the diametrically opposite pairs of recesses 28. Sensed rotation as to drag-torque change is thus possible, at four discrete 90°-spaced rotary positions, for each full relative revolution of parts 11–12.

The described container will be seen to achieve all stated objects, without requiring added component parts. Detent action is realizable at as many discrete increments of rotation as desired in that the described four is by no means a requirement. And the parts are readily manufactured by modern production techniques, involving injection-molding of suitable plastic materials. And automated assembly is realizable, merely by axial insertion of parts to each other, even for assembly of threaded tail 16 to base part 18, by sufficiently weakening the upper rim of part 18 (as at slot 32), for stiffly compliant yielding entry of follower lugs 19 into the respective thread formations.

The described peripheral seal of carrier-cup lip 15 to the inner wall of body shell 12 will be seen to enable a filling of the described container when cup 13 is at its lowermost position, the filling being with pomade which is throughout the inner volume defined by the concavity of cup 14 and by that part of the body shell 12 which extends from lip 15 to the upper open end of the body shell. Advancing relative rotation of parts 11–12 is therefore one of driving a plug of pomade to slide along the bodyshell wall to which it was filled, but this will be understood to involve driving torque which is at noticeable contrast to the torquing transient which identifies each pomade-metering increment.

We claim:

1. A cosmetic container, comprising a base member having a lower end with an enlarged external profile that is polygonal and having a tubular upper end in partially telescoping axially retained rotatable relation within one end of the bore of an outer tubular sleeve member, the remainder of the bore of said tubular sleeve member having a somewhat polygonal sectional profile that is reduced from but corresponds to the polygonal profile of said base member, a carrier cup slidable within said remainder of the bore of said tubular member and having a somewhat polygonal peripheral contour for non-rotational reference to said outer tubular member, said carrier cup having an externally threaded propulsion stem extending into and in threaded engagement with at least a part of the tubular upper end of said base member, said outer tubular sleeve member having an external profile that is polygonal and corresponds to and is reduced from the profile of said base member, said base member having a radially outward circumferentially extending shoulder formation confronting the adjacent axial end of said tubular sleeve member, axially coacting detent formations on said shoulder and said adjacent axial end and providing compliantly yieldable detent action at each of a plurality of equal angular increments of relative rotation of said members, said plurality corresponding to the number of sides of said polygonal profile, the external profiles of said base member and of said sleeve member being in angular register at occurrence of coaction between detent formations, a circumferentially continuous elastomeric seal ring in retained assembly to said base member and axially beneath the region of detent action, said seal ring having an external course which is somewhat polygonal consistent with and slightly exceeding the external profile of said sleeve member, and a closure cap having a bore of polygonal profile corresponding to and slidable over the polygonal external profile of said outer tubular sleeve member, said closure cap being removably engageable over and hermetically sealing said outer tubular member and carrier cup when in circumferentially continuous interference-fit relation with said seal ring.

2. The container of claim 1, in which a second circumferentially extending shoulder formation of said base member is of greater radial extent than said first-mentioned shoulder formation and is axially beneath the retained assembly of said seal ring, said second shoulder formation providing an axially limiting stop upon container closure by said cap.

3. The container of claim 1, in which the number of angularly spaced locations of detent action is at least two, for each full revolution of said relative rotation.

4. The container of claim 3, in which said number is four.

5. The container of claim 1, in which a circumferential external groove formation at the upper end of said base member and at least one snap lug integrally formed in the bore of said outer tubular member provide cammed axial-locating engagement of said members upon mutual telescoping assembly of the upper end of said base member to said one end of the bore of said sleeve member.

6. The container of claim 2, in which said base member is of two-part construction wherein said first-mentioned shoulder formation is integral with a first part having a tubular lower end extending axially below said shoulder formation, and wherein the second part is a cup in circumferentially continuous fixed assembly over and to said tubular lower end, said cup having a skirt which establishes said second shoulder formation.

7. The container of claim 1, in which said seal ring in unstressed condition has a cylindrical bore and a circumferentially continuous outwardly bulging external profile, and in which said seal ring is retained in axially bridging relation with an external circumferential groove formation of said base member, whereby said seal ring may compliantly yield to forced radially inward deformation in approach to cap closure of said container.

8. The container of claim 7, in which an undercut radially inward groove formation in said closure cap has axially retaining engagement with the bulging external profile of said seal ring upon cap closure of said container.

9. A cosmetic container, comprising a base member having a lower end with an enlarged external profile that is polygonal and having a tubular upper end in partially telescoping axially retained rotatable relations within one end of the bore of an outer tubular sleeve member, the remainder of the bore of said tubular sleeve member having a somewhat polygonal sectional profile that is reduced from but corresponds to the polygonal profile of said base member, a carrier cup slidable within said remainder of the bore of said tubular member and having a somewhat polygonal peripheral contour for non-rotational reference to said outer tubular member, said carrier cup having an externally threaded propulsion stem extending into and in threaded engagement with at least a part of the tubular upper end of said base member, said outer tubular sleeve member having an external profile that is polygonal and corresponds to and is reduced from the profile of said base member, said base member having a radially outward circumferentially extending shoulder formation confronting the adjacent axial end of said tubular sleeve member, and axially coacting detent formations on said shoulder and said adjacent axial end and providing compliantly yieldable detent action at each of a plurality of equal angular increments of relative rotation of said members, said plurality corresponding to the number of sides of said polygonal profile, the external profiles of said base member and of said sleeve member being in angular register at occurrence of coaction between detent formations.

* * * * *